US011141836B2

(12) United States Patent
Chae

(10) Patent No.: US 11,141,836 B2
(45) Date of Patent: Oct. 12, 2021

(54) METHOD OF FABRICATING SANDPAPER FOR GRINDING INDUSTRIAL PARTS AND SANDPAPER FABRICATED BY THE METHOD

(71) Applicant: Jongduck Chae, Seoul (KR)

(72) Inventor: Jongduck Chae, Seoul (KR)

( * ) Notice: Subject to any disclaimer, the term of this patent is extended or adjusted under 35 U.S.C. 154(b) by 177 days.

(21) Appl. No.: 16/122,954

(22) Filed: Sep. 6, 2018

(65) Prior Publication Data

US 2019/0160631 A1 May 30, 2019

(30) Foreign Application Priority Data

Nov. 24, 2017 (KR) ..... 10-2017-0158993

(51) Int. Cl.
*B24D 9/06* (2006.01)
*B24D 18/00* (2006.01)

(52) U.S. Cl.
CPC ..... *B24D 18/0036* (2013.01); *B24D 9/06* (2013.01); *B24D 18/0072* (2013.01)

(58) Field of Classification Search
CPC ..... B24D 18/0072; B24D 13/16; B24D 18/0036; B24D 9/06; B24D 9/00; B24D 9/006
See application file for complete search history.

(56) References Cited

U.S. PATENT DOCUMENTS 2,296,615 A * 9/1942 Illmer ..... B24D 9/06 451/299
4,536,994 A 8/1985 Krebs
6,705,931 B2 * 3/2004 Moolenaar ..... B24B 23/005 451/342
2005/0107019 A1 * 5/2005 Lee ..... B26F 1/20 451/529
2005/0272360 A1 12/2005 Tyranowski
(Continued)

FOREIGN PATENT DOCUMENTS

EP 0847322 B1 4/2001
EP 2937178 A 10/2015
JP H05-223340 A 8/1993
(Continued)

OTHER PUBLICATIONS

Machine English Translation for JP-2004330319-A, Dtae Nov. 2004, Uchida, Toshiyasu.*

*Primary Examiner* — Alexandra M Moore
(74) *Attorney, Agent, or Firm* — KORUS Patent, LLC; Seong Il Jeong

(57) ABSTRACT

Disclosed herein are a method of fabricating sandpaper for grinding industrial parts and sandpaper fabricated by the method. The method includes: a cutting step of cutting sandpaper to a set length; a cutoff hole formation step of forming a plurality of cutoff holes in one side periphery of the sandpaper in a lengthwise direction; a winding step of forming a roll of sandpaper by winding the sandpaper around one side of a spindle; a taping step of temporarily fastening the roll of sandpaper by winding tape; a bonding step of securely fastening the one side of the roll of sandpaper by applying bond to a side surface of the roll of sandpaper; and a drying step of drying the bond for a set time. In the sandpaper, a plurality of cutoff holes is formed in one side periphery of the sandpaper in a lengthwise direction.

1 Claim, 5 Drawing Sheets

(56) References Cited

U.S. PATENT DOCUMENTS

| | | | | |
|---|---|---|---|---|
| 2014/0120811 | A1* | 5/2014 | Schoch | B24D 18/00<br>451/527 |
| 2016/0051283 | A1 | 2/2016 | Runden et al. | |

FOREIGN PATENT DOCUMENTS

| | | | | |
|---|---|---|---|---|
| JP | 2004-330319 | A | | 11/2004 |
| JP | 2004330319 | A | * | 11/2004 |
| KR | 10-1999-0044244 | A | | 6/1999 |
| KR | 10-2005-0046513 | A | | 5/2005 |
| KR | 10-1023749 | B1 | | 3/2011 |
| KR | 10-2016-0003701 | A | | 1/2016 |

* cited by examiner

METHOD OF FABRICATING SANDPAPER FOR GRINDING INDUSTRIAL PARTS AND SANDPAPER FABRICATED BY THE METHOD

BACKGROUND

1. Technical Field

The present invention relates generally to sandpaper capable of grinding jewels, molds, and general industrial parts, and more specifically to: a method of fabricating sandpaper for grinding industrial parts, the method including: a cutting step of cutting sandpaper to a set length by means of a cutting machine to fit the location of a spindle; a cutoff hole formation step of forming a plurality of cutoff holes in one side periphery of the sandpaper, obtained at the cutting step, in a lengthwise direction by means of a hole formation machine; a winding step of forming a roll of sandpaper by winding the sandpaper, obtained at the cutoff hole formation step, around one side of the spindle by means of a winding machine; a taping step of temporarily fastening the roll of sandpaper, obtained at the winding step, by winding tape around the one side of the roll of sandpaper in order to prevent the roll of sandpaper from being unwound; a bonding step of securely fastening the one side of the roll of sandpaper by applying bond to a side surface of the roll of sandpaper, obtained at the taping step, on the one side around which the tape has been wound; and a drying step of drying the bond, applied to the side surface of the roll of sandpaper obtained at the bonding step, in a drying furnace for a set time in order to set the bond; and sandpaper in which a plurality of cutoff holes is formed in one side periphery of the sandpaper in a lengthwise direction. Accordingly, worn sandpaper can be cut off through the guidance of the plurality of cutoff holes, formed in the sandpaper that is wound around one side of the spindle configured to be inserted into and rotated by the electric tool and that is fastened by the tape and the bond, in a circumferential direction in an orderly fashion, thereby obtaining a neat cutoff section in the circumferential direction, and, once the circumferential direction cutoff has been completed via the plurality of cutoff holes formed in the sandpaper, a cutoff reference point has been already set, and thus the worn sandpaper can be cut off straight also in the lengthwise direction of a roll of sandpaper, thereby preventing a layer from being formed on the roll of sandpaper, with the result that the sandpaper can always perform precise grinding operation in a flat state.

2. Description of the Related Art

A conventional roll of sandpaper formed by winding sandpaper around a spindle 2 and configured to grind various types of industrial parts while the sandpaper is being rotated by an electric tool 11, as shown in FIG. 1, is configured by forming a roll in such a way as to wind sandpaper 1, cut to an appropriate length, around one side of the spindle 2, forming a tape layer 3 in such a way as to wind tape around the lower side of the roll of sandpaper and thus temporarily fastening the roll of sandpaper, and forming a bond layer 4 in such a way as to apply bond to thus maintain the shape of the roll, as shown in FIGS. 2 and 3.

According to the above-described conventional technology, the sandpaper 1 maintains a flat state in its initial stage, as shown in FIG. 3, and thus the sandpaper 1 can perform precise grinding operation.

However, when the sandpaper 1 is used for a predetermined period, it is worn out, and thus it must be replaced with new sandpaper 1.

In other words, in order to replace the worn sandpaper 1, when a user rotates the spindle 2 in a reverse direction while pulling the end portion of the worn sandpaper 1 as if peeling off the skin of an onion, the new sandpaper 1 wound next to the worn sandpaper 1 is exposed to the outside. In this case, the worn sandpaper 1 to be peeled often tears off arbitrarily, and thus several layers are formed, as shown in FIG. 4.

As described above, when a layer is formed on a roll of sandpaper 1, the roll of sandpaper 1 itself is not flat, but is tapered, and thus the roll of sandpaper 1 must perform grinding operation in a tilted state. Accordingly, a problem occurs in that it cannot perform precise grinding operation.

Meanwhile, as a conventional preceding invention, there is a "grinding element" (Korean Patent Application Publication No. 10-2016-0003701).

The conventional preceding invention relates to "a grinding element, and a grinding tool including a drive device configured to rotate the grinding element and a means configured to connect the drive device with the grinding tool, wherein the grinding element includes at least one internal coupling layer, an external coupling layer, and a multi-layered grinding layer having grinding particles, the internal coupling layer is formed as a structure layer having one or more bonding agents, the external coupling layer is formed as a cover layer having another bonding agent, and a temperature-sensitive discoloration dye is provided in the external coupling layer.

The conventional preceding invention relates to the grinding element that is mounted on an electric tool and that performs grinding operation. However, the conventional preceding invention is different from the present invention in that new sandpaper is used in such a way as to peel sandpaper in a wound state.

SUMMARY

The present invention has been conceived to overcome the above-described problem, and an object of the present invention is to provide a method of fabricating sandpaper and sandpaper fabricated by the method, by which worn sandpaper can be cut off through the guidance of a plurality of cutoff holes, formed in the sandpaper that is wound around one side of a spindle configured to be inserted into and rotated by an electric tool and that is fastened by tape and bond, in a circumferential direction in an orderly fashion, thereby obtaining a neat cutoff section in the circumferential direction, and by which, once the circumferential direction cutoff has been completed via the plurality of cutoff holes formed in the sandpaper, a cutoff reference point has been already set, and thus the worn sandpaper can be cut off straight also in the lengthwise direction of a roll of sandpaper, thereby preventing a layer from being formed on the roll of sandpaper, with the result that the sandpaper can always perform precise grinding operation in a flat state.

In order to accomplish the above object, the present invention provides: a method of fabricating sandpaper, the method including: a cutting step of cutting sandpaper to a set length by means of a cutting machine to fit the location of a spindle; a cutoff hole formation step of forming a plurality of cutoff holes in one side periphery of the sandpaper, obtained at the cutting step, in a lengthwise direction by means of a hole formation machine; a winding step of forming a roll of sandpaper by winding the sandpaper, obtained at the cutoff hole formation step, around one side of the spindle by means of a winding machine; a taping step of temporarily fastening the roll of sandpaper, obtained at the winding step, by winding tape around the one side of the roll of sandpaper in order to prevent the roll of sandpaper from being unwound; a bonding step of securely fastening the one side of the roll of sandpaper by applying bond to a side surface of the roll of sandpaper, obtained at the taping step, on the one side around which the tape has been wound; and a drying step of drying the bond, applied to the side surface of the roll of sandpaper obtained at the bonding step, in a drying furnace for a set time in order to set the bond; and sandpaper in which a plurality of cutoff holes is formed in one side periphery of the sandpaper in a lengthwise direction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
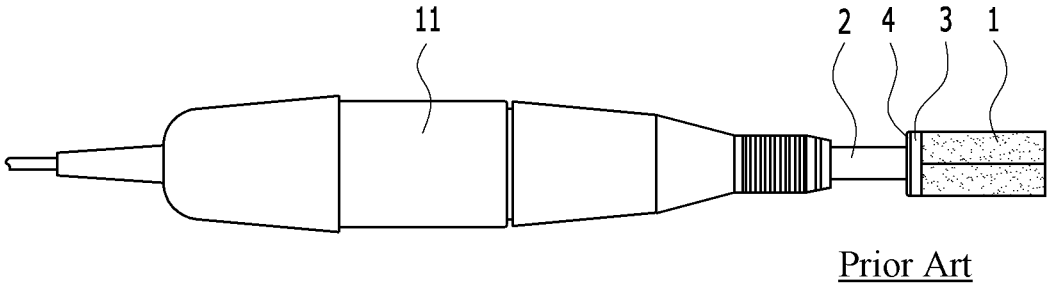
FIG. 1 is a view showing a state in which conventional sandpaper has been coupled to an electric tool.
Figure 2:
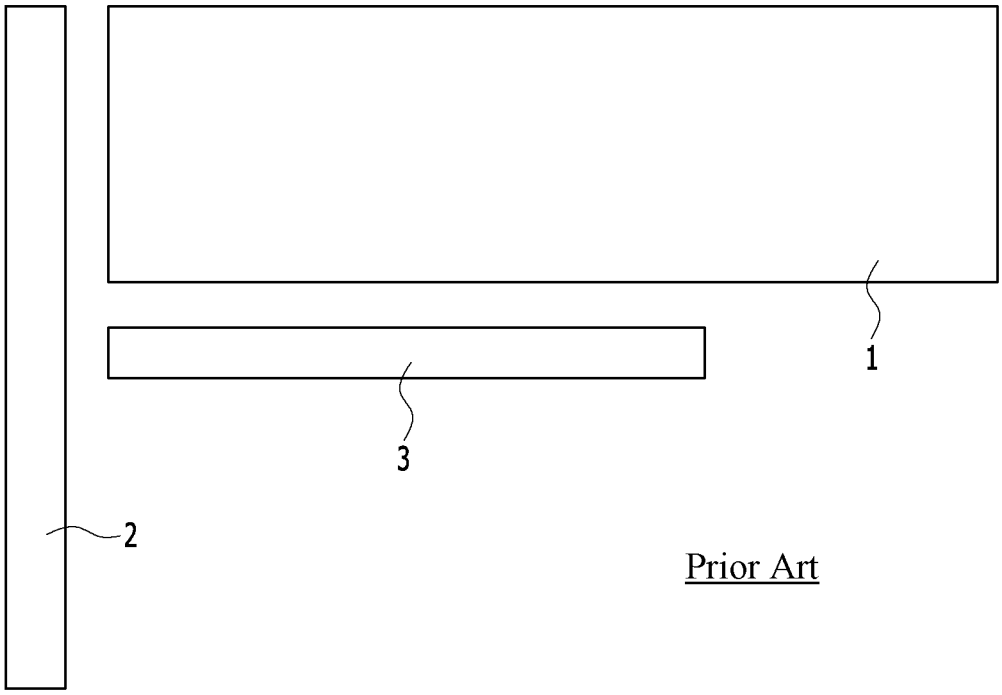
FIG. 2 is a view illustrating the process of forming a conventional roll by winding sandpaper.
Figure 3:
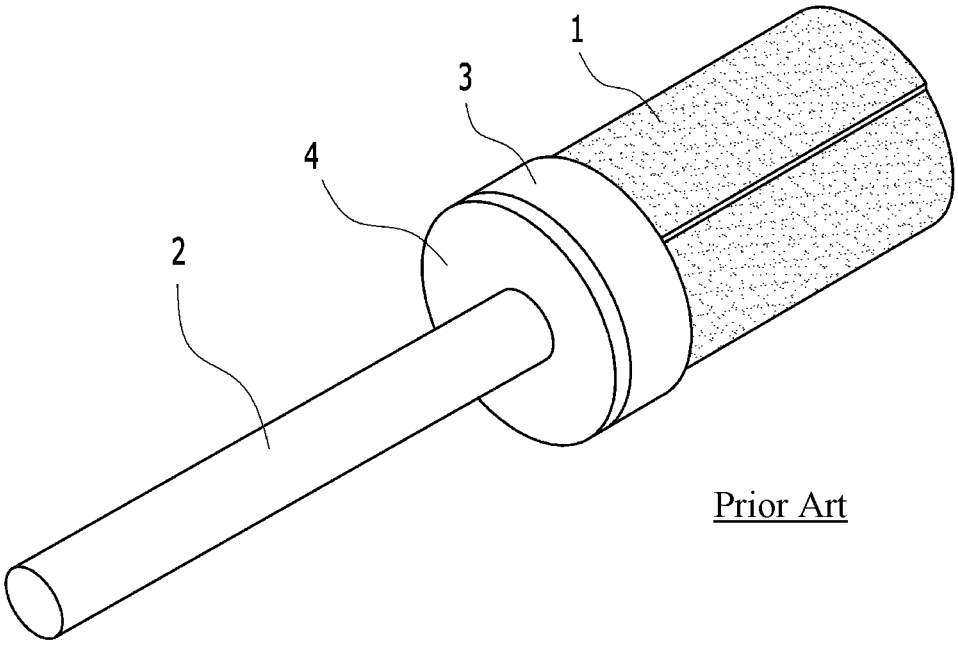
FIG. 3 is a perspective view illustrating the structure of the conventional roll formed by winding sandpaper.
Figure 4:
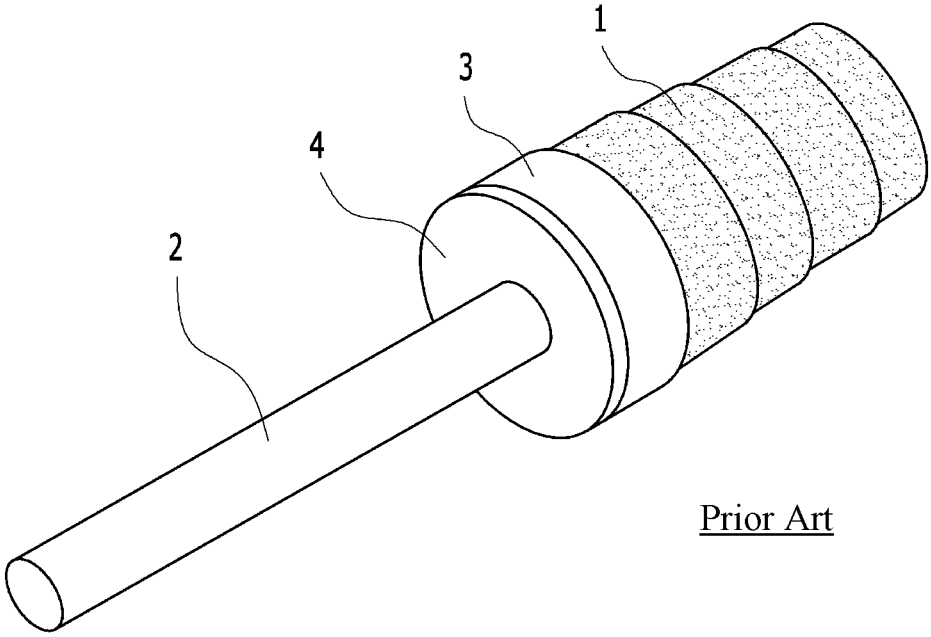
FIG. 4 is a perspective view illustrating the problem of the conventional roll of sandpaper.

The process of fabricating sandpaper in which cutoff holes have been formed according to the present invention will be described in detail with reference to the flowchart of the accompanying FIG. 5.

The process of fabricating sandpaper includes:

a cutting step S101 of cutting sandpaper 101 to a set length by means of a cutting machine to fit the location of a spindle 103;

a cutoff hole formation step S102 of forming a plurality of cutoff holes 102 in one side periphery of the sandpaper 101, obtained at the cutting step S101, in a lengthwise direction by means of a hole formation machine;

a winding step S103 of forming a roll of sandpaper 101 by winding the sandpaper 101, obtained at the cutoff hole formation step S102, around one side of the spindle 103 by means of a winding machine;

a taping step S104 of temporarily fastening the roll of sandpaper 101, obtained at the winding step S103, by winding tape 104 around the one side of the roll of sandpaper 101 in order to prevent the roll of sandpaper 101 from being unwound;

a bonding step S105 of securely fastening the one side of the roll of sandpaper 101 by applying bond 105 to the side surface of the roll of sandpaper 101, obtained at the taping step S104, on the one side around which the tape 104 has been wound; and a drying step S106 of drying the bond 105, applied to the side surface of the roll of sandpaper 101 obtained at the bonding step S105, in a drying furnace for a set time in order to set the bond 105.

Meanwhile, the configuration of sandpaper in which cutoff holes have been formed according to the present invention will be described in detail with reference to FIGS. 6 and 7.

In the sandpaper in which cutoff holes have been formed according to the present invention, in order to precisely and conveniently cut off a worn portion of the sandpaper 101 that is wound around one side of the spindle 103 configured to be inserted into and rotated by an electric tool 11 and that is fastened by the tape 104 and the bond 105, the plurality of cutoff holes 102 is formed in one side periphery of the sandpaper 101 at equal intervals S in the lengthwise direction.

Figure 5:
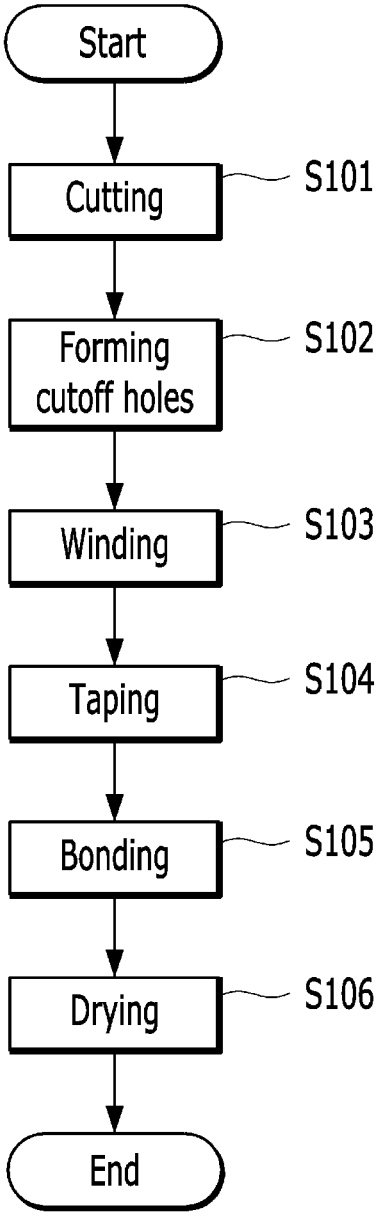
FIG. 5 is a flowchart illustrating the process of fabricating sandpaper in which cutoff holes have been formed according to the present invention.

The operation of the method of fabricating sandpaper according to the present invention will be described as follows:

FIG. 5 is a flowchart illustrating the process of fabricating sandpaper in which cutoff holes have been formed according to the present invention. In this drawing, "S" refers to "step" that is used to describe the process.

First, at the cutting step S101, the sandpaper 101 is cut to a set length by means of a cutting machine (not shown) to fit the location of the spindle 103.

Furthermore, at the cutoff hole formation step S102, a plurality of cutoff holes 102 is formed in one side periphery of the sandpaper 101, obtained at the cutting step S101, in a lengthwise direction by means of a hole formation machine (not shown).

Furthermore, at the winding step S103, a roll of sandpaper 101 is formed by winding the sandpaper 101, obtained at the cutoff hole formation step S102, around one side of the spindle 103 by means of a winding machine (not shown).

Furthermore, at the taping step S104, the roll of sandpaper 101 obtained at the winding step S103 is temporarily fastened by winding tape 104 around one side of the roll of sandpaper 101 in order to prevent the roll of sandpaper 101 roll from being unwound.

Furthermore, at the bonding step S105, the side of the roll of sandpaper 101 is securely fastened by applying the bond 105 to the side surface of the roll of sandpaper 101, obtained at the taping step S104, on the side around which the tape 104 has been wound.

Furthermore, at the drying step S106, the bond 105 applied to the side surface of the roll of sandpaper 101 obtained at the bonding step S105 is dried in a drying furnace (not shown) for a set time, thereby obtaining a complete roll of sandpaper 101.

Figure 6:
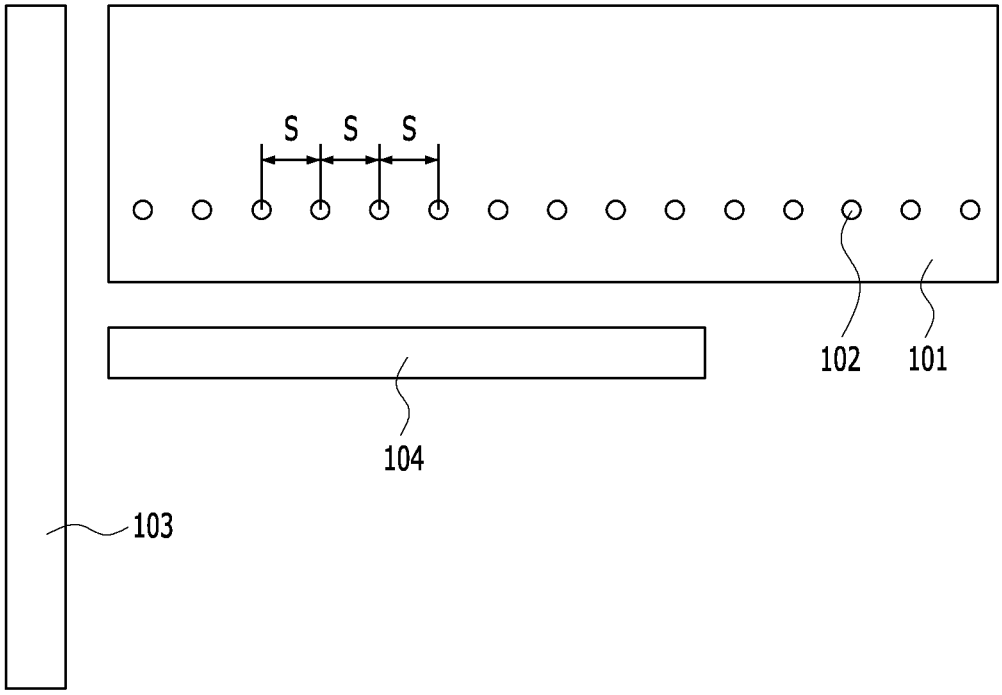
FIG. 6 is a view illustrating the process of forming a roll by winding the sandpaper in which cutoff holes have been formed according to the present invention.
Figure 7:
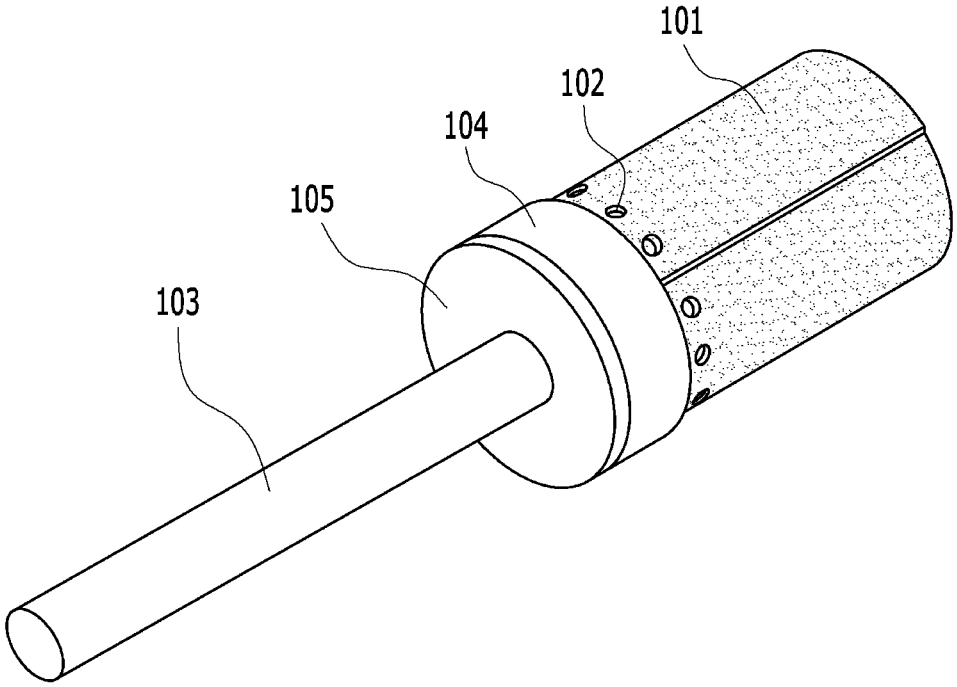
FIG. 7 is a perspective view illustrating the structure of the roll formed by winding the sandpaper in which cutoff holes have been formed according to the present invention.
Figure 8:
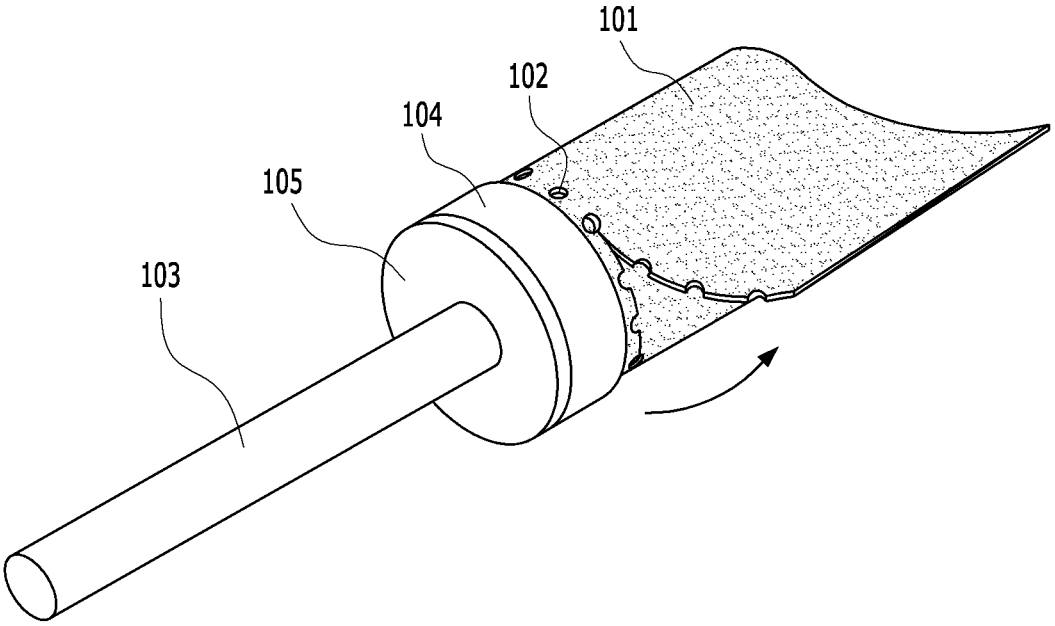
FIG. 8 is a view showing a state in which the sandpaper in which cutoff holes have been formed according to the present invention is cut off in a circumferential direction.

Meanwhile, the operation of the sandpaper according to the present invention is as follows:

FIG. 6 is a view illustrating the process of forming a roll by winding the sandpaper in which cutoff holes have been formed according to the present invention, and FIG. 7 is a perspective view illustrating the structure of the roll formed by winding the sandpaper in which cutoff holes have been formed according to the present invention. In the roll of sandpaper 101 according to the present invention, worn sandpaper 101 can be cut off through the guidance of the plurality of cutoff holes 102, formed in the sandpaper 101 that is wound around one side of the spindle 103 configured to be inserted into and rotated by the electric tool 11 and that is fastened by the tape 104 and the bond 105, in a circumferential direction, as shown in FIG. 8.

Figure 9:
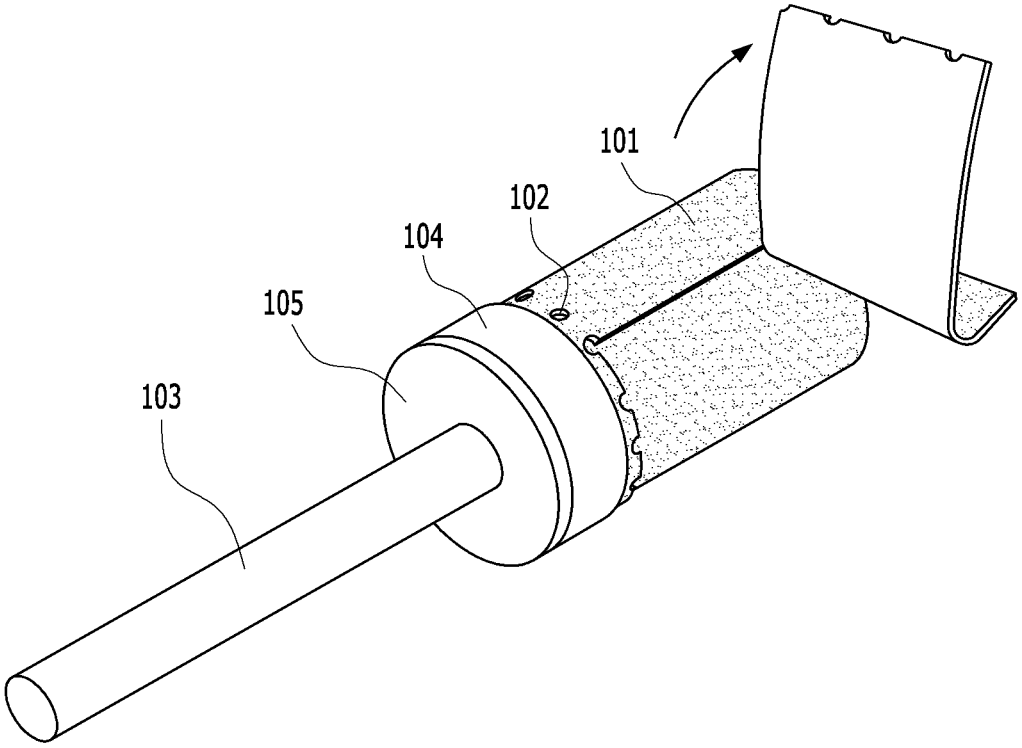
FIG. 9 is a view showing a state in which the sandpaper in which cutoff holes have been formed according to the present invention is cut off in a lengthwise direction.

Furthermore, once the circumferential direction cutoff has been completed via the plurality of cutoff holes 102 formed in the sandpaper 101, a cutoff reference point has been already set. Accordingly, the worn sandpaper 101 can be cut off straight also in the lengthwise direction of the roll of sandpaper 101, as shown in FIG. 9, thereby preventing a layer from being formed on the roll of sandpaper 101.

Accordingly, according to the present invention, the sandpaper 101 remains flat until the overall sandpaper 101 is unwound and used, as shown in FIG. 7, and thus more precise grinding operation can last a long time.

Furthermore, the cutoff holes 102 are formed at equal intervals S, and thus the intervals between the cutoff holes 102 are relatively uniformly cut off when a cutoff is perform in the circumferential direction.

According to the present invention, worn sandpaper can be cut off through the guidance of the plurality of cutoff holes, formed in the sandpaper that is wound around one side of the spindle configured to be inserted into and rotated by the electric tool and that is fastened by the tape and the bond, in a circumferential direction in an orderly fashion, thereby providing the effect of obtaining a neat cutoff section in the circumferential direction.

According to the present invention, once the circumferential direction cutoff has been completed via the plurality of cutoff holes formed in the sandpaper, a cutoff reference point has been already set, and thus the worn sandpaper can be cut off straight also in the lengthwise direction of the roll of sandpaper, thereby preventing a layer from being formed on the roll of sandpaper, with the result that a useful effect can be achieved in that the sandpaper can always perform precise grinding operation in a flat state.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A grinding apparatus including a sandpaper comprising:

a spindle onto which the sandpaper is wound, the spindle being configured to be inserted into and rotated by an electric tool;

a tape which fastens a lateral side portion of the sandpaper by winding the tape on the lateral side portion of the sandpaper to prevent a sandpaper roll which comprises the sandpaper wound onto the spindle from being unwound; and a bond which is installed on a lateral side of the sandpaper roll and in contact with a lateral side of the tape, and fastens the lateral side of the sandpaper roll by bonding, the sandpaper comprising a plurality of cutoff holes wherein the plurality of cutoff holes are formed on the sandpaper along a boundary line between an opposite lateral side of the tape and the sandpaper such that the plurality of cutoff holes are arranged circumferentially at equal intervals, the plurality of cutoff holes being separation holes along which a worn-out portion of the sandpaper is cut in a circumferential direction, and the sandpaper being configured to be cut longitudinally and uniformly by setting a single cutoff hole from the cutoff holes as a cutoff reference point, whereby the worn-out portion of the sandpaper is precisely and easily cut along the cutoff holes and then separated from the sandpaper roll.

* * * * *